US008474384B2

(12) United States Patent
Sundarrao

(10) Patent No.: US 8,474,384 B2
(45) Date of Patent: Jul. 2, 2013

(54) FOLDING ARMREST TRAY FOR WHEELCHAIRS

(75) Inventor: Stephen Sundarrao, Tampa, FL (US)

(73) Assignee: University of South Florida, Tampa, FL (US)

( * ) Notice: Subject to any disclaimer, the term of this patent is extended or adjusted under 35 U.S.C. 154(b) by 83 days.

(21) Appl. No.: 12/887,057

(22) Filed: Sep. 21, 2010

(65) Prior Publication Data

US 2011/0067606 A1 Mar. 24, 2011

Related U.S. Application Data

(63) Continuation-in-part of application No. 11/871,454, filed on Oct. 12, 2007, now abandoned.

(60) Provisional application No. 60/829,220, filed on Oct. 12, 2006.

(51) Int. Cl.
*A47B 37/00* (2006.01)

(52) U.S. Cl.
USPC ..... 108/42; 108/44

(58) Field of Classification Search
USPC ..... 108/42–44, 48
See application file for complete search history.

(56) References Cited

U.S. PATENT DOCUMENTS

| | | | | |
|---|---|---|---|---|
| 1,303,280 | A * | 5/1919 | Fliedner | 108/3 |
| 1,851,906 | A * | 3/1932 | Henderson | 312/196 |
| 2,583,097 | A * | 1/1952 | Heimann | 248/456 |
| 3,475,052 | A * | 10/1969 | Kaposi | 297/153 |
| 4,944,552 | A | 7/1990 | Harris | |
| 5,026,114 | A * | 6/1991 | Miller | 297/145 |
| 5,547,247 | A | 8/1996 | Dixon | |
| 5,799,964 | A | 9/1998 | Chao | |
| 6,427,957 | B1 | 8/2002 | Finneman et al. | |
| 2005/0178297 | A1* | 8/2005 | Pipkin | 108/25 |
| 2007/0283855 | A1* | 12/2007 | Pozzi | 108/44 |
| 2008/0006749 | A1* | 1/2008 | Ferritto | 248/188.6 |
| 2010/0044543 | A1* | 2/2010 | Ramey, III | 248/449 |

FOREIGN PATENT DOCUMENTS

WO 2008046040 A3 4/2008

OTHER PUBLICATIONS

International Search Report for PCT/US07/81212 dated Aug. 26, 2008.

* cited by examiner

*Primary Examiner* — Janet M Wilkens
*Assistant Examiner* — Timothy M Ayres
(74) *Attorney, Agent, or Firm* — Andriy Lytvyn; Smith & Hopen, P.A.

(57) ABSTRACT

A tray assembly mounted on a wheelchair. A housing containing the tray is mounted along the side of the chair arm. The tray assembly has a tray surface moveable between a stowed and unstowed position.

5 Claims, 11 Drawing Sheets

FOLDING ARMREST TRAY FOR WHEELCHAIRS

CROSS REFERENCE TO RELATED APPLICATIONS

This application is a continuation-in-part of U.S. nonprovisional patent application Ser. No. 11/871,454, entitled "Folding Armrest Tray for Wheelchairs," filed on Oct. 12, 2007, which claims priority to U.S. provisional patent application No. 60/829,220, entitled "Folding Armrest Tray for Wheelchairs," filed on Oct. 12, 2006, the contents of which are herein incorporated by reference.

BACKGROUND OF THE INVENTION

1. Field of the Invention

This invention relates to devices for assisting people confined to wheelchairs and the like. More specifically, it relates to a folding armrest and tray assembly.

2. Descriptions of the Prior Art

Individuals with disabilities using power wheelchairs often have limited reach and are unable to use traditional desks and tables. In some environments, such as restaurants and the workplace, these individuals use trays attached to their wheelchair for convenience and accessibility. While there are many wheelchair trays on the market, none store out of the way when not in use without increasing the width/dimensions of the wheelchair, which interferes with accessibility. Most designs are rigid, one-piece designs that are bulky and do not fit the user. The problem is that these trays are fixed and require assistance to attach and detach. Moreover, they must be stored elsewhere on the wheelchair when not in use.

Accordingly, there is a need for a lightweight tray that is simple to use and is integrated into the ergonomic armrest design of commercially available wheelchairs. However, in view of the prior art considered as a whole at the time the present invention was made, it was not obvious to those of ordinary skill in the art how the limitations of the art could be overcome.

SUMMARY OF INVENTION

The long-standing but heretofore unfulfilled need for a lightweight tray that is simple to use and is integrated into the ergonomic armrest design of commercially available wheelchairs is now met by a new, useful, and nonobvious invention.

The integrated wheelchair-armrest provides a mechanism to store a portable tray surface, computer, or communication device ideal for use with a wheelchair. The articulating tray is disposed within a housing which is designed to accommodate most commercially available wheelchairs. In a first embodiment, the articulating tray includes a rotating support, a base plate pivotally connected to the rotating support, the base plate adapted to pivot between a first position and second position. A tray support is pivotally connected to the base plate. The tray support is adapted to pivot between a first position and a second position. A tray is connected to the tray support.

In a second embodiment, a housing is adapted to encompass the tray when it is in a stowed position. The housing is further adapted to be affixed to the side of most commercially available wheelchairs, thereby providing substantially universal use of the device.

In a third embodiment, the tray is releasably connected to the tray support. Moreover, the tray is slidingly connected to the tray support and is moveable between a first position and a second position. The tray of an embodiment is adapted to incline and is height adjustable.

In yet another embodiment, the armrest includes a housing having a first side, a second side, a front, a back, a bottom, and a pivoting armrest collectively forming a hollow rectangular structure when the pivoting armrest is in a closed position. A tray support arm is pivotally and hingedly connected to the housing. While stowed, the support arm is in a vertical repose position within the housing. The support arm hingedly rotates from the stowed position to a second unstowed position outside of the housing. Once out of the housing, the rotating support arm is free to pivot in a horizontal plane.

A tray is slideably and hingedly connected to the support arm. The tray is slideably extended and retracted and hingedly opened and closed while in the second unstowed position outside of the housing. Moreover, the tray includes an inner portion that is hingedly connected to the outer portion and is adapted to tilt. A bracket is used to secure the inner portion of the tray in the upright tilted position.

To use the tray, a user pivots the armrest to the open position and rotates the support arm and tray assembly into the second unstowed position. Once in the second unstowed position, the user can adjust the location of the tray by either pivoting the support arm in a horizontal plane or sliding the tray along the support arm in a horizontal plane. The user may also open and close the tray between a horizontal plane and a vertical plane. Moreover, the user may tilt the inner portion of the tray upwardly and secure it in place.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
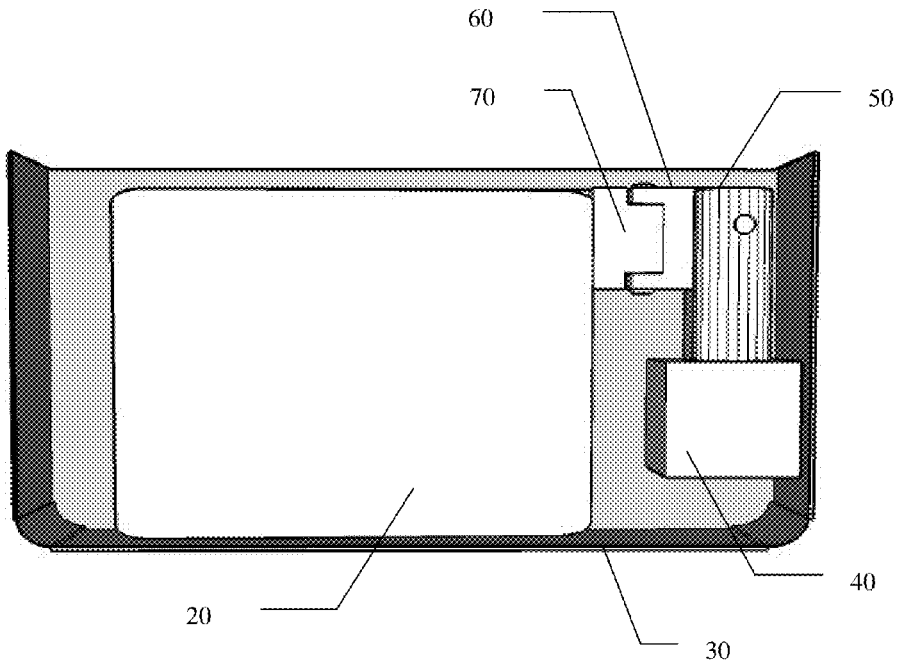
FIG. 1 is a side view of the invention in the stowed position, wherein the base plate is in the first position.
Figure 2:
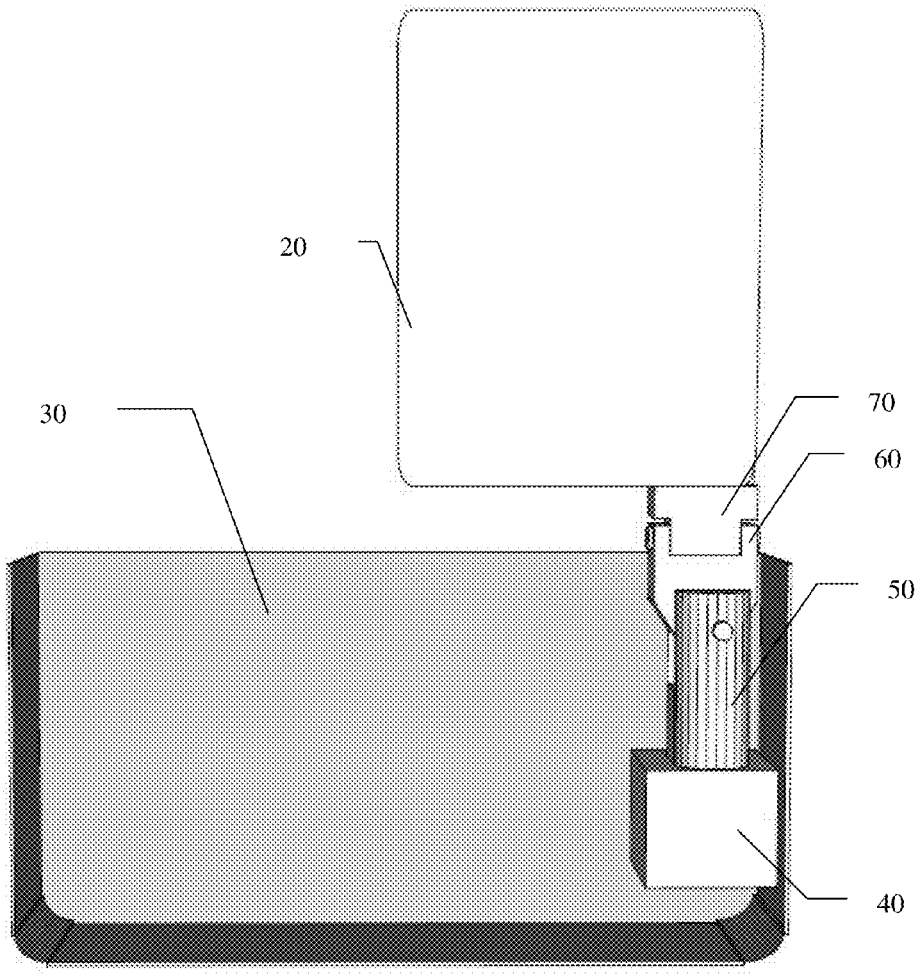
FIG. 2 is a side view of the invention in the transition position wherein the base plate is in the second position and the tray support is in the first position.
Figure 3:
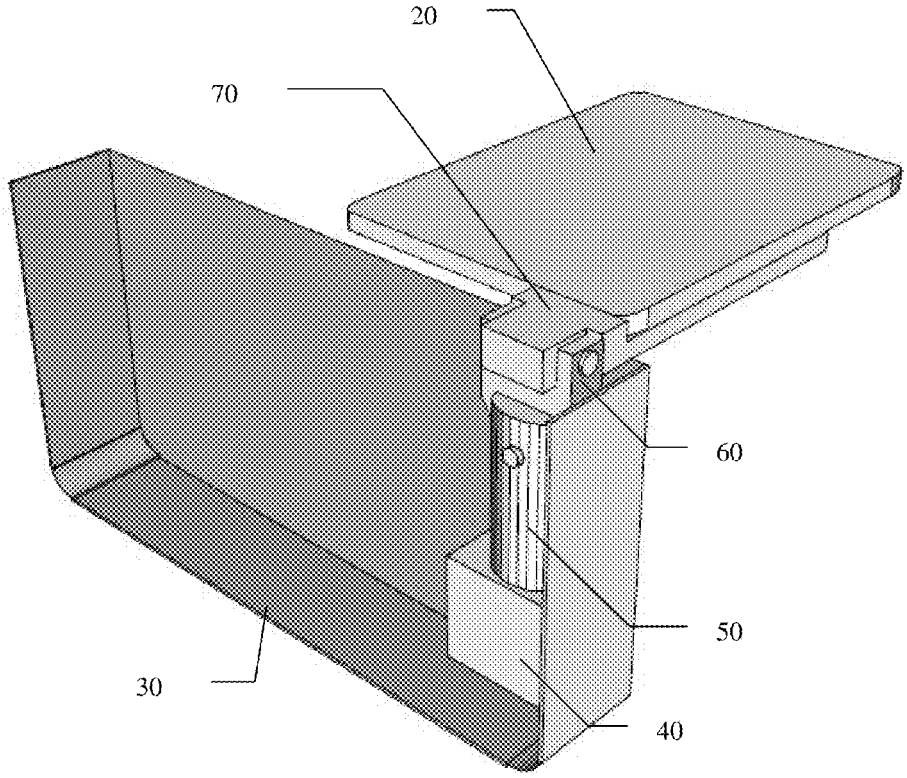
FIG. 3 is a perspective view of the invention in the deployed position wherein the tray support is in the second position and the tray and rotating support are in their respective first positions.

In a first embodiment, the invention includes an articulating tray for use with a wheelchair. Referring now to FIG. 1, wherein tray 20 is shown in the stored position and is encompassed by housing 30 (housing 30 is depicted with the cover removed). In the embodiment of FIG. 1, anchor 40 is attached to the interior of housing 30. Anchor 40, however, can also be attached to numerous other structures without departing from the scope of the invention. For example, anchor 40 can be affixed directly to the wheelchair such as in embodiments where housing 30 is not used.

Figure 4:
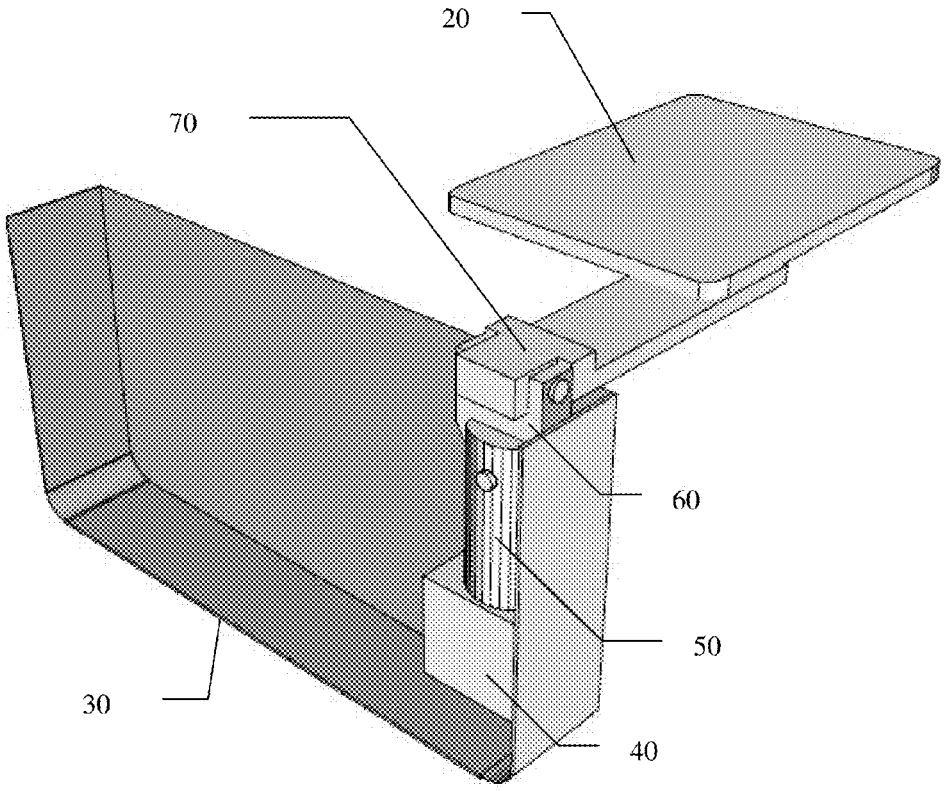
FIG. 4 is a perspective view of the invention wherein the tray is in the second position.
Figure 5:
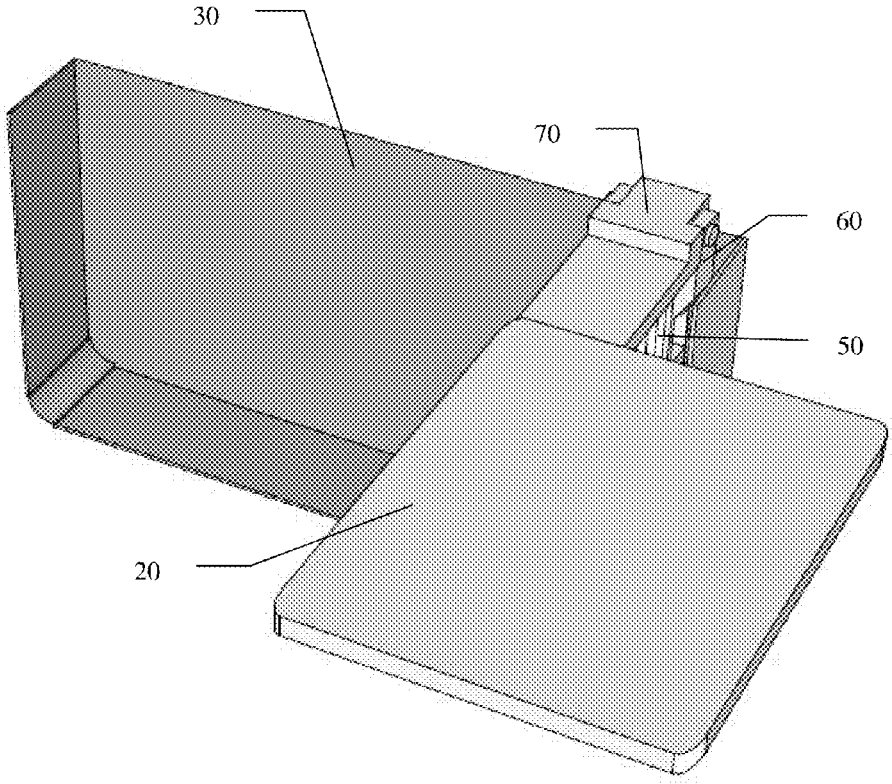
FIG. 5 is a perspective view of the invention wherein the rotating support is in the second position.

Rotating support 50 is pivotally connected to anchor 40 such that rotating support 40 pivots along a central axis between a first position, as depicted in FIGS. 1-4, and a second position, as depicted in FIG. 5. Base plate 60 is pivotally connected to rotating support 50 and is adapted to rotate between a first position (FIG. 1) and second position (FIGS. 2-6) along an axis that is substantially perpendicular to the axis of rotation of rotating support 50.

Tray support 70 is hingedly connected to base plate 60. In an embodiment, tray support 70 is connected to base plate 60 by a friction hinge. As used herein, a friction hinge is a hinge which exerts torque between two parts on a common axis. Alternatively, the use of other hinges is within the scope of the invention. For example, tray support 70 can be connected to base plate 60 by a detent hinge; a device which allows repeatable "soft stops" in one or more positions between two parts on a common axis. In this manner, tray support 70 rotates between a first position (FIGS. 1 and 2) and a second position (FIGS. 3-6).

Tray 20 is slidingly connected to tray support 70 in a preferred embodiment. This sliding engagement allows tray 20 to move between a first position (FIG. 3) and a second position (FIG. 4). FIG. 5 illustrates an alternative position of tray 20 wherein the assembly is rotated around rotating support 50 such that rotating support is in its second position. This places tray 20 to side of the wheelchair.

Figure 6:
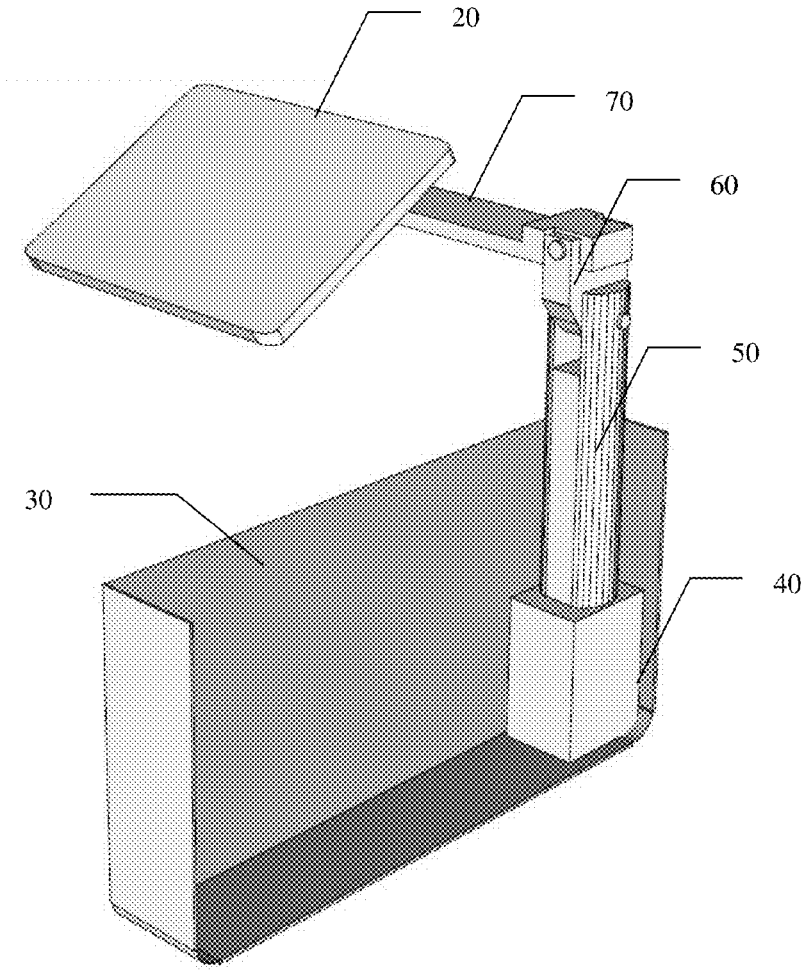
FIG. 6 is a perspective view of an alternate embodiment wherein the tray is hingedly connected to the tray support and the rotating support is telescopically connected to the housing.

In an embodiment, depicted in FIG. 6, tray 20 is also hingedly connected to tray support 70. This permits the angle of tray 20 to be adjusted. While the use of a friction hinge is preferred, any type of hinge can be used as will be appreciated by one of ordinary skill in the art. The embodiment of FIG. 6 also shows a modified rotating support 50 telescopically connected to anchor 40. This arrangement allows the height of the tray to be adjusted. It also preferable to provide a quick-release connection between tray 20 and tray support 70 to allow tray 20 to be removed and replace with either a new tray or other device (such as a modified laptop computer).

As it will be appreciated, tray 20 provides the majority of the invention's functionality. Tray 20 is preferably formed by injection molding a compound of polypropylene. Polypropylene is preferable because it is durable, inexpensive, and can be extruded from recycled materials and be transparent to allow visibility for wheelchair mobility. All the features are included in the single molded piece so that all manufacturing complexity is contained within the one time purchase of the die. The tray, in one embodiment, is 18×12×1 inches in size, making it large enough to hold a meal, support a laptop computer, or provide space for writing or drawing. All corners are rounded to prevent any sharp edges from injuring the user.

Tray 20 can also contain convenient features, such as cup holders and the like. Additionally, tray 20 is molded with a 0.25 inch lip around the perimeter so that any liquids that are inadvertently spilled onto the surface will be contained within the perimeter of the tray rather than running off onto the vehicle or user. This symmetry provides support for flat objects placed on the tray (such as a laptop computer). In addition, power outlets provide power supply to the user from the existing wheelchair battery.

The main working area of the tray is a flat surface that can be used for holding food, for writing or drawing, or for support of a laptop computer. The surface is slightly tilted toward the front of the tray so that any writing utensils placed on the tray will roll to the front. At the very front of the tray is a groove to be used for the storage of pens or pencils. The center of the groove contains a clip to tightly secure a standard sized pen or pencil. The utensil simply needs to be snapped into the clip for storage. Once snapped into place, the utensil is snugly secured in place.

Figure 7:
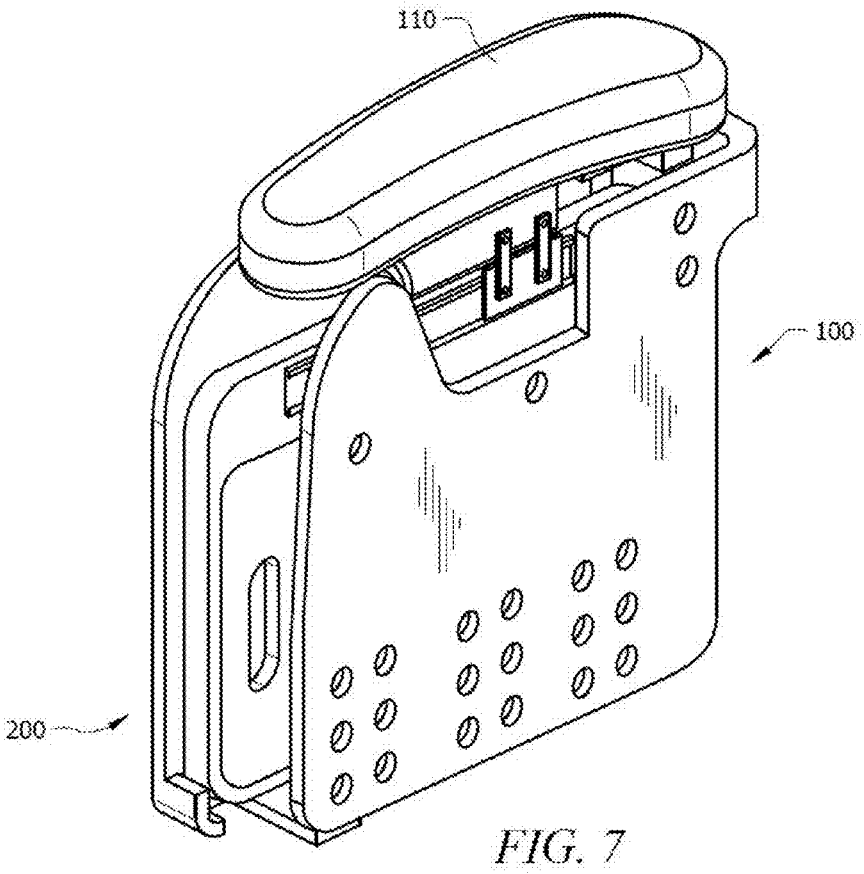
FIG. 7 a perspective view of an alternate embodiment of the tray assembly depicting the tray in the stowed position.

In a preferred embodiment, as depicted in FIG. 7, the stowable tray includes housing 100 having pivoting armrest top 110. Housing 100 and pivoting armrest 110 collectively form a hollow rectangular structure when pivoting armrest 110 is in a closed position. Because housing 100 is positioned directly below armrest 110, it can be positioned laterally on a wheelchair underneath the arms of a user, which saves space.

Figure 8:
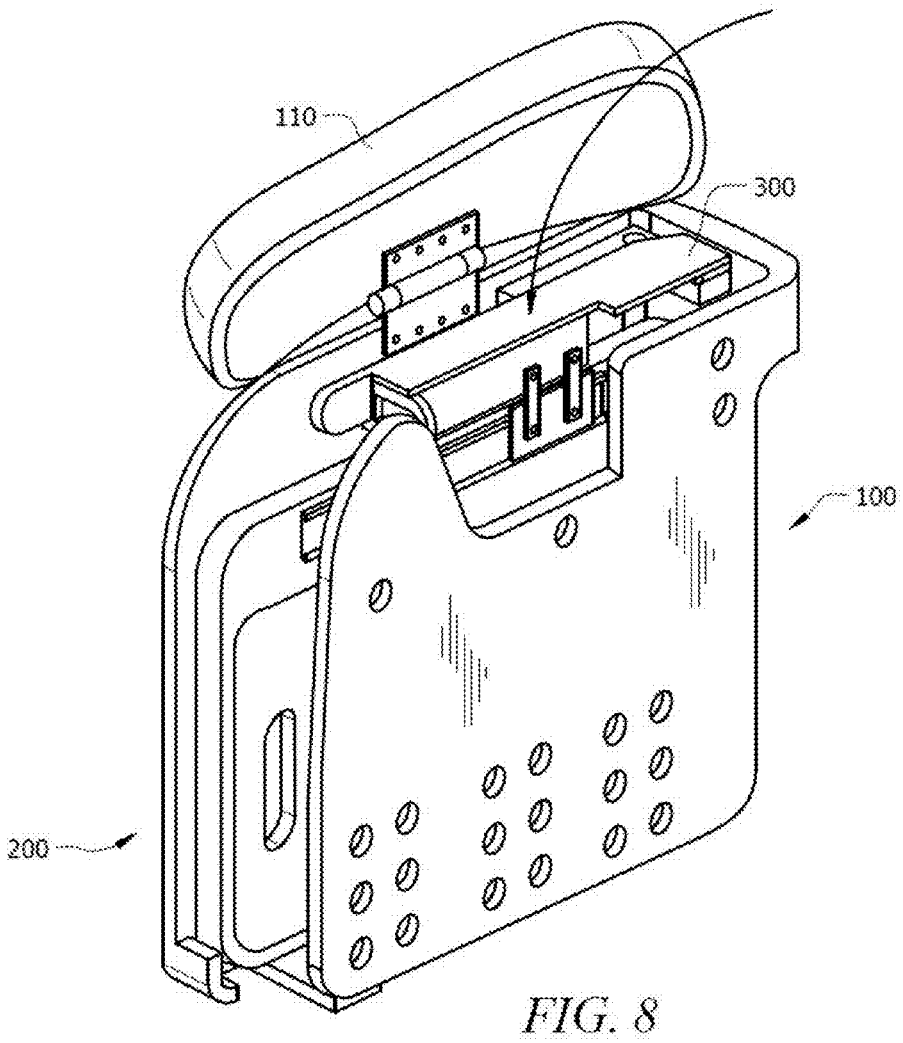
FIG. 8 is a perspective view of an alternate embodiment of the tray assembly depicting the tray in the stowed position.

As depicted in FIG. 8, pivoting armrest 110 is rotated into the open position thereby allowing support arm 300 and tray 200 to be removed from housing 100. Support arm 300 is pivotally and hingedly connected to housing 100 by a horizontal pivot and a vertical hinge. A universal joint may also be used. In the stowed position, as depicted in FIGS. 7 and 8, support arm 300 is in a horizontal repose position within housing 100.

Figure 9:
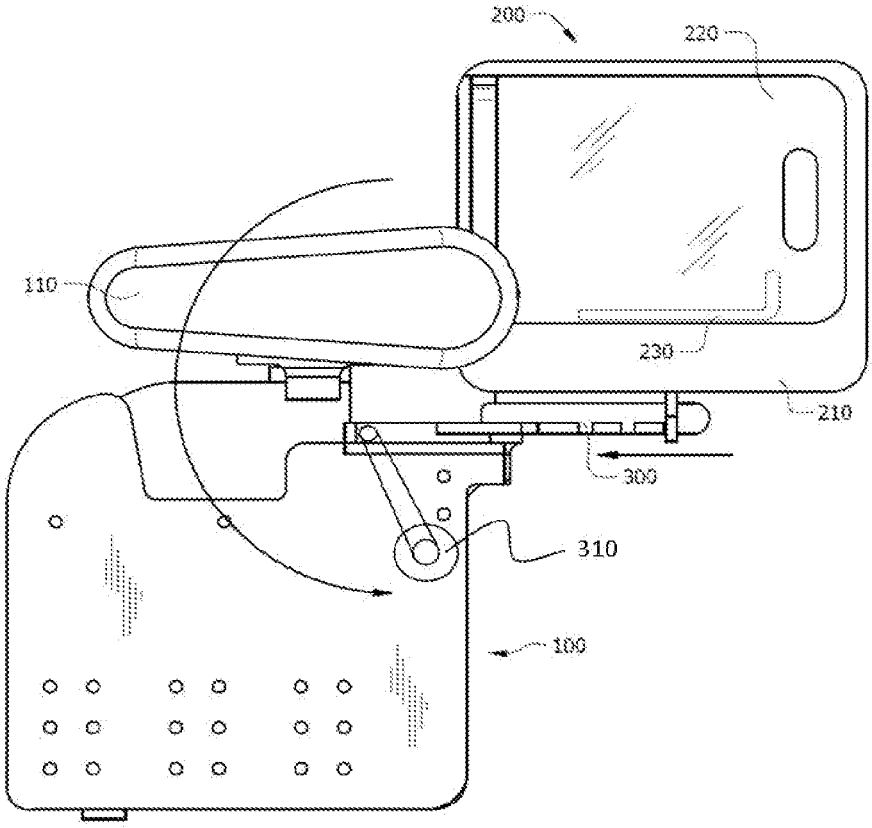
FIG. 9 is a side view of an alternate embodiment of the tray assembly depicting the tray in a vertical plane.

Support arm 300 rotates within a vertical plane from the stowed horizontal position to a second unstowed position outside of housing 100, as depicted in FIGS. 8 and 9. In order to rotate support arm 300 in a vertical plane, pivoting armrest top 110 is in the open position.

Figure 10:
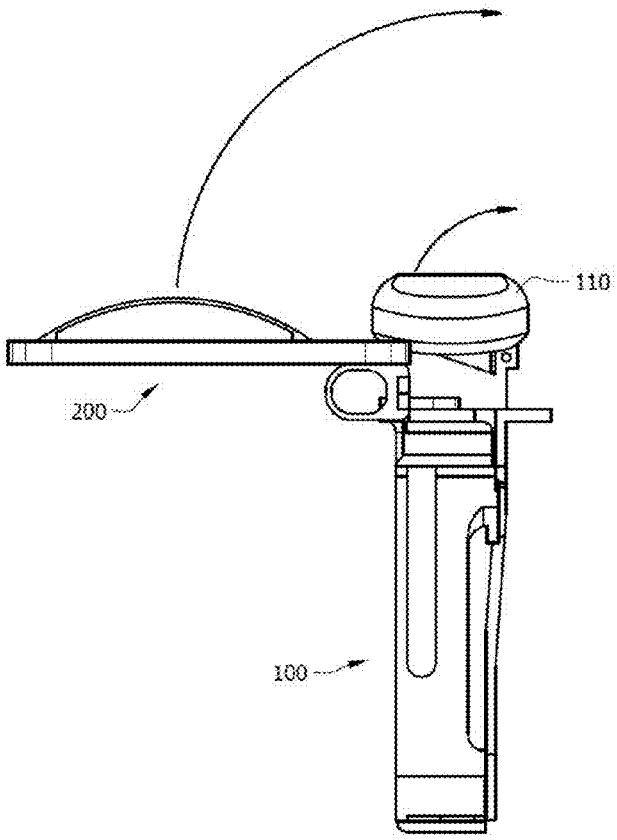
FIG. 10 is a front view of an alternate embodiment of the tray assembly depicting the tray in a horizontal plane.
Figure 11:
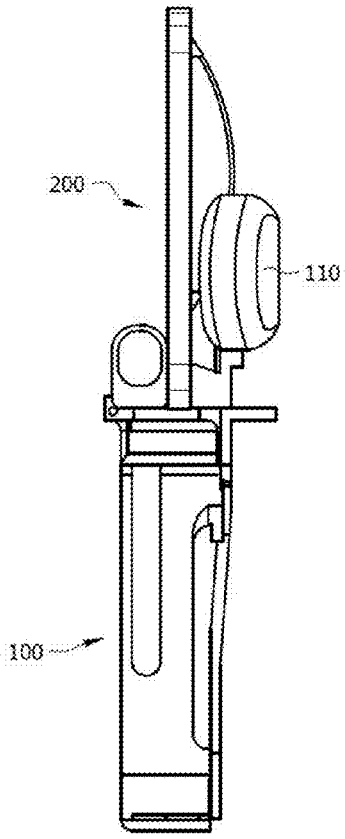
FIG. 11 a front view of an alternate embodiment of the tray assembly depicting the tray in a vertical plane.

As depicted in FIGS. 9 and 10, tray 200 is slideably and hingedly connected to support arm 300. Like support arm 300, tray 200 rotates from a first stowed position within housing 100 to a second unstowed position outside of housing 100. Because tray 200 is slideably connected to support arm 300, a user can extend and retract tray 200 along the end points of support arm 300. Similarly, because tray 200 is hingedly connected to support arm 300, a user can open and close tray 200 between a vertical and horizontal position, as depicted in FIGS. 10 and 11.

Figure 12:
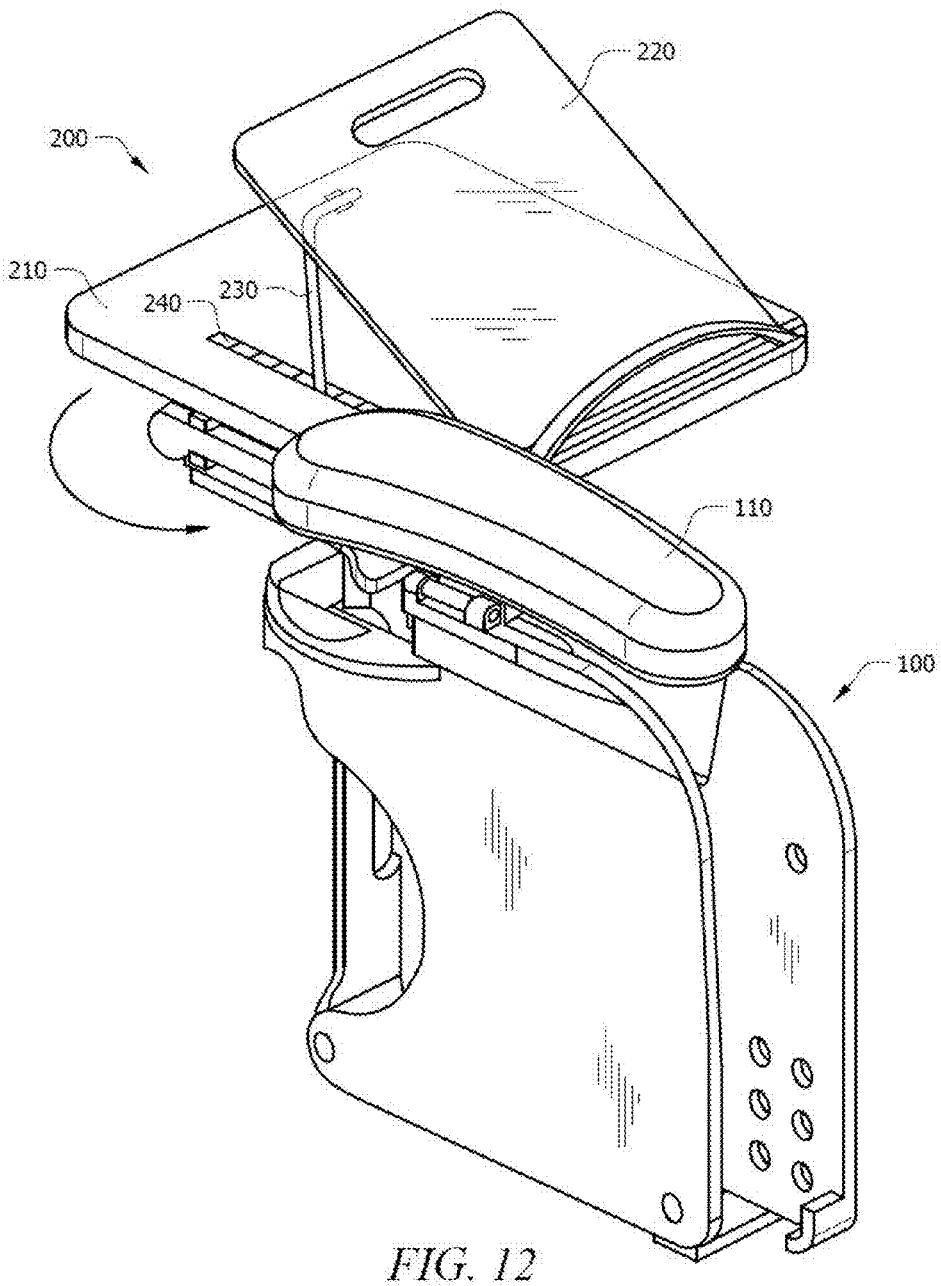
FIG. 12 is a perspective view of an alternate embodiment of the tray assembly depicting the tray in the second unstowed position.

Once out of housing 100 and in the unstowed position, rotating support arm 300 and tray 200 are free to pivot in a horizontal plane, as shown in FIG. 12.

Still referring to FIG. 12, tray 200 includes inner portion 220 that is hingedly connected to outer portion 210 and is adapted to be tilted upward. Bracket 230 has a first end that slides within slot 240 and a second end attached to inner portion 220 and is used to secure the inner portion of the tray in the upright tilted position.

An extension tray (not shown) may additionally be hingedly connected to tray 200. The extension tray has a first closed position in overlying relation to tray 200. If a user needs additional surface space, the tray extension is extended to an open position whereby the extension tray is rotated about its hinge 180 degrees so that it abuts and is coplanar with tray 200.

Referring to FIG. 9, an actuator may be incorporated to mechanically move tray 200 from the stowed position within housing 100 to the unstowed position outside of housing 100. The actuator depicted in FIG. 9 is a belt-pulley system driven by electric motor 310. The invention, however, is not limited to this type of actuator, and a variety of other actuators known in the art may be used without departing from the scope of the invention.

As collectively shown in FIGS. 7-12, to make use of the tray, a user simply pivots the armrest to the open position and rotates the support arm and tray assembly into the horizontal unstowed position. Once in the horizontal plane, the user can adjust the location of the tray by either rotating the support arm in a horizontal plane or sliding the tray along the support arm in a horizontal plane. The user may then tilt the inner portion of the tray up and secure it in place.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described.

What is claimed is:

1. A stowable support system, comprising:

a housing having a first side, a second side, a front, a back, a bottom, and a pivoting armrest collectively forming a hollow structure when said pivoting armrest is in a closed position;

a single support arm having an elongated body, a first end, and a second end, said first end of said support arm being hingedly connected to said housing, said support arm rotating in a vertical plane about a horizontal hinge axis by essentially 180° from a first position within said housing to a second position outside of said housing, said support arm also being pivotally connected to said housing, wherein said support arm pivots in a horizontal plane about a vertical pivot axis by at least about 180° while in said second position; and a tray having an outer portion and an inner portion, said inner portion of said tray being hingedly connected to said outer portion of said tray, said outer portion of said tray being slideably connected to said support arm allowing said tray to slide along said elongated body of said support arm, said outer portion of said tray also being hingedly connected to said support arm allowing said tray to pivot between a vertical closed position and a horizontal operational position while said support arm is in said second position outside of said housing.

2. A stowable support system as in claim 1, further comprising:

support means to hold said inner tray in a tilted position.

3. A stowable support system as in claim 1, further comprising:

said inner portion of said tray being transparent.

4. A stowable support system as in claim 1, further comprising:

actuation means to remove said tray from said housing.

5. A stowable support system as in claim 1, further comprising:

said support arm being hingedly connected to said housing by a friction hinge to reduce amount of effort required to transition said support arm between said stowed position and said unstowed position.

* * * * *